US011011112B2

(12) United States Patent
Li et al.

(10) Patent No.: US 11,011,112 B2
(45) Date of Patent: May 18, 2021

(54) ORGANIC LIGHT-EMITTING DISPLAY PANEL AND ORGANIC LIGHT-EMITTING DISPLAY DEVICE

(71) Applicant: Shanghai Tianma AM-OLED Co., Ltd., Shanghai (CN)

(72) Inventors: Yue Li, Shanghai (CN); Xingyao Zhou, Shanghai (CN); Mengmeng Zhang, Shanghai (CN); Shuai Yang, Shanghai (CN); Zhi Liu, Shanghai (CN); Zhe Zhao, Shanghai (CN)

(73) Assignee: Shanghai Tianma AM-OLED Co., Ltd., Shanghai (CN)

( * ) Notice: Subject to any disclaimer, the term of this patent is extended or adjusted under 35 U.S.C. 154(b) by 0 days.

(21) Appl. No.: 16/712,691

(22) Filed: Dec. 12, 2019

(65) Prior Publication Data

US 2020/0410926 A1 Dec. 31, 2020

(30) Foreign Application Priority Data

Jun. 28, 2019 (CN) ..... 201910587538.X

(51) Int. Cl.
*G09G 3/325* (2016.01)
*G09G 3/3291* (2016.01)

(52) U.S. Cl.
CPC ..... *G09G 3/325* (2013.01); *G09G 3/3291* (2013.01); *G09G 2310/027* (2013.01)

(58) Field of Classification Search
CPC . G09G 3/325; G09G 3/3291; G09G 2310/027
See application file for complete search history.

(56) References Cited

U.S. PATENT DOCUMENTS 6,501,448 B1 * 12/2002 Komiya ..... G09G 3/3233 345/80
2017/0047003 A1 * 2/2017 Kim ..... G09G 3/3233

FOREIGN PATENT DOCUMENTS

CN 104464619 A 3/2015
CN 105513534 A 4/2016

OTHER PUBLICATIONS

B. Van Zeghbroech, Principles of Semiconductor Devices, 2011, https://ecee.colorado.edu/~bart/book/book/chapter7/ch7_3.htm, 7 pages.*

* cited by examiner

*Primary Examiner* — Chanh D Nguyen
*Assistant Examiner* — Ngan T. Pham-Lu
(74) *Attorney, Agent, or Firm* — Christensen O'Connor Johnson Kindness PLLC

(57) ABSTRACT

Provided is an organic light-emitting display panel including: a first pixel driving circuit driving a first sub-pixel and including first driving transistors, and a second pixel driving circuit driving a second sub-pixel and including one or more second driving transistors. An operating current of the first sub-pixel at a preset grayscale is n times an operating current of the second sub-pixel at the preset grayscale, n≥1.5. The first driving transistor includes first and second driving sub-transistors. The first driving sub-transistor has a gate electrode electrically connected to a gate electrode of the second driving sub-transistor, a first electrode electrically connected to a first electrode of the second driving sub-transistor, and a second electrode electrically connected to a second electrode of the second driving sub-transistor. The number of the one or more second driving transistors is smaller than the number of the first driving transistors.

18 Claims, 8 Drawing Sheets

（PRIOR ART）

ORGANIC LIGHT-EMITTING DISPLAY PANEL AND ORGANIC LIGHT-EMITTING DISPLAY DEVICE

CROSS-REFERENCE TO RELATED APPLICATIONS

The present application claims priority to Chinese Patent Application No. 201910587538.X, filed on Jun. 28, 2019, the content of which is incorporated herein by reference in its entirety.

TECHNICAL FIELD

The present disclosure relates to the field of display technologies, and particularly, to an organic light-emitting display panel and an organic light-emitting display device.

BACKGROUND

With the increase of consumption, since an efficiency of a blue sub-pixel in an organic light-emitting display panel is low, a current $I_b$ that is required for the blue sub-pixel is approximately twice a current $I_r$ for a red sub-pixel and a current $I_g$ for a green pixel to achieve the same brightness, i.e., $I_r=I_g=\frac{1}{2}I_b$. Due to a design of a large-sized panel, a voltage drop of a power supply voltage at an end far away from a driving chip integrated circuit (IC) becomes larger, for example, the voltage drop at an end far away from the IC is ΔV. Referring to FIG. 1 illustrating an Ids-Vgs curve of a driving transistor, a larger current Ids corresponds to a smaller slope S of the curve, i.e., a slope $S_b$ of the blue sub-pixel is smaller than a slope $S_g$ of the green sub-pixel or a slope $S_r$ of the red sub-pixel. Further, because $S_b=\Delta I_b/\Delta V$, $S_r=\Delta I_r/\Delta V$ and $S_g=I_g/\Delta V$, then $\Delta I_b<\Delta I_r$ and $\Delta I_b<I_g$. That is, with a same voltage drop of the power supply voltage, a change amount of the current for causing the blue sub-pixel to emit blue light is smaller than that for the green sub-pixel to emit green light or that for the red sub-pixel to emit red light, which generates a deviation of chroma and causes the end far away from the IC to be yellowish.

SUMMARY

In view of this, the present disclosure provides an organic light-emitting display panel and an organic light-emitting display device including the organic light-emitting display panel to solve the above technical problem.

In a first aspect of the present disclosure, an organic light-emitting display panel is provided. The organic light-emitting display panel includes sub-pixels and pixel driving circuits for driving the sub-pixels; wherein the sub-pixels include a first sub-pixel and a second sub-pixel, and the pixel driving circuits include a first pixel driving circuit and a second pixel driving circuit; the first pixel driving circuit includes first driving transistors and is configured to drive the first sub-pixel, and the second pixel driving circuit includes one or more second driving transistors and is configured to drive the second sub-pixel; an operating current of the first sub-pixel at a preset grayscale is n times an operating current of the second sub-pixel at the preset grayscale, where n≥1.5; and the first driving transistors include a first driving sub-transistor and a second driving sub-transistor, a gate electrode of the first driving sub-transistor is electrically connected to a gate electrode of the second driving sub-transistor, a first electrode of the first driving sub-transistor is electrically connected to a first electrode of the second driving sub-transistor, a second electrode of the first driving sub-transistor is electrically connected to a second electrode of the second driving sub-transistor, and a number of transistors of the one or more second driving transistors is smaller than a number of transistors of the first driving transistors.

In a second aspect, an organic light-emitting display device is provided. The display device includes an organic light-emitting display panel, and the organic light-emitting display panel includes sub-pixels and pixel driving circuits for driving the sub-pixels; the sub-pixels include a first sub-pixel and a second sub-pixel, and the pixel driving circuits include a first pixel driving circuit and a second pixel driving circuit; the first pixel driving circuit includes first driving transistors and is configured to drive the first sub-pixel, and the second pixel driving circuit includes one or more second driving transistors and is configured to drive the second sub-pixel; an operating current of the first sub-pixel at a preset grayscale is n times an operating current of the second sub-pixel at the preset grayscale, where n≥1.5; the first driving transistors include a first driving sub-transistor and a second driving sub-transistor, a gate electrode of the first driving sub-transistor is electrically connected to a gate electrode of the second driving sub-transistor, a first electrode of the first driving sub-transistor is electrically connected to a first electrode of the second driving sub-transistor, a second electrode of the first driving sub-transistor is electrically connected to a second electrode of the second driving sub-transistor, and a number of transistors of the one or more second driving transistors is smaller than a number of transistors of the first driving transistors.

BRIEF DESCRIPTION OF DRAWINGS

In order to more clearly illustrate technical solutions of embodiments of the present disclosure, the accompanying drawings used in the embodiments are introduced as below. These drawings merely illustrate some embodiments of the present disclosure. On the basis of these drawings, those skilled in the art can also obtain other drawings.

DESCRIPTION OF EMBODIMENTS

In order to better understand technical solutions of the present disclosure, the embodiments of the present disclosure are described in detail with reference to the drawings.

It should be clear that the described embodiments are merely part of the embodiments of the present disclosure rather than all of the embodiments. Based on these embodiments in the present disclosure, all other embodiments obtained by those skilled in the art shall fall into the protection scope of the present disclosure.

The terms used in the embodiments of the present disclosure are merely for the purpose of describing specific embodiments, rather than limiting the present disclosure. The terms "a", "an", "the" and "said" in a singular form in the embodiments of the present disclosure and the attached claims are also intended to include plural forms thereof, unless noted otherwise.

It should be understood that the term "and/or" used in the context of the present disclosure is to describe a correlation relation of related objects, indicating that there may be three relations, e.g., A and/or B may indicate only A, both A and B, and only B. In addition, the symbol "/" in the context generally indicates that the relation between the objects in front and at the back of "/" is an "or" relationship.

It should be understood that although the terms 'first', 'second', 'third' and so on may be used in the present disclosure to describe sub-pixels, the sub-pixels should not be limited to these terms. These terms are used only to distinguish the sub-pixels from each other. For example, without departing from the scope of the embodiments of the present disclosure, a first sub-pixel may also be referred to as a second sub-pixel. Similarly, the second sub-pixel may also be referred to as the first sub-pixel.

Figure 1:
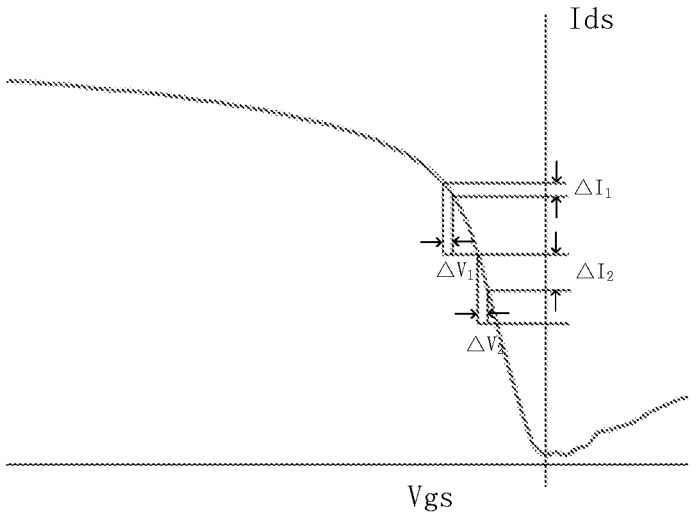
FIG. 1 illustrates an Ids-Vgs curve of a driving transistor in the related art.

As mentioned in the technical background, referring to FIG. 1 illustrating an Ids-Vgs curve of a driving transistor in the related art, since the light-emitting efficiency differs due to a difference in materials of sub-pixels of two different colors in an organic light-emitting display panel, luminescence currents of the sub-pixels of different colors are also different when a same brightness is achieved. Referring to FIG. 1, a region with a relatively large current (the region where the Ids is relatively large) in the Ids-Vgs curve of the driving transistor corresponds to a relatively small slope, that is, the same voltage drop causes a relatively small current difference in the region with a relatively large current. Due to the design of a large-sized panel, the voltage drop of the power supply voltage becomes larger at the end that is far away from the IC (because the power supply voltage is supplied from the driving chip IC to a side far away from the driving chip). For example, at the side far away from the driving chip IC, a voltage drop of the power supply voltage of the first sub-pixel is $\Delta V_1$ and a current change caused by the voltage drop is $\Delta I_1$; a voltage drop of the power supply voltage of the second sub-pixel is $\Delta V_2$, and a current change caused by the voltage drop is $\Delta I_2$; when the first sub-pixel and the second sub-pixel are located at the same position at the end far away from the IC, i.e., $\Delta V_1=\Delta V_2$, then it can be seen that, because the first sub-pixel has a higher working current, it results that $\Delta I_2>\Delta I_1$ (referring to the Ids-Vgs curve of the driving transistor). Therefore, the first sub-pixel has a smaller current drop than the second sub-pixel at the end far away from the IC. And because a luminescence efficiency of the first sub-pixel is low, the same current only produces a smaller reduction value of brightness. According to the foregoing derivation $\Delta I_2>\Delta I_1$, a reduction value of brightness of the first sub-pixel is smaller than a reduction value of brightness of the second sub-pixel, thereby causing a ratio of brightness of the first sub-pixel to the second sub-pixel to change compared with an end near the IC, and a color cast. For example, since the blue sub-pixel is made of a fluorescent material, and the green sub-pixel and the red sub-pixel are made of a phosphorescent material, the efficiency of the blue sub-pixel is lower. Therefore, the current $I_b$ required for the blue sub-pixel is approximately twice a current $I_r$ for the red sub-pixel and a current $I_g$ for the green sub-pixel, that is, $I_r=I_g=\frac{1}{2}I_b$. Since the slope S of the curve is relatively small when the current Ids is relatively large (that is, a slope $S_b$ of the blue sub-pixel is smaller than a slope $S_g$ of the green sub-pixel or a slope $S_r$ of the red sub-pixel), $S_b=\Delta I_b/\Delta V$, $S_r=A\ I_r/\Delta V$ and $S_g=\Delta I_g/\Delta V$, then $\Delta I_b<\Delta I_r$ and $\Delta I_b<\Delta I_g$. Stated differently, under a same voltage drop of the power supply voltage, a change amount of a current of the blue sub-pixel is smaller than that of the red sub-pixel or that of the green sub-pixel. However, due to a lower luminescence efficiency, the blue sub-pixel has a smaller brightness reduction under the same current drop, which causes a deviation in chromaticity and the end far away from the IC to be yellowish. Referring to FIG. 1, the power supply voltage PVDD is generated by a driving chip or a power chip close to the driving chip, and is transmitted from the end near the IC to the end far away from the IC, a voltage drop is resulted from a resistance of a power supply voltage signal line during transmission. The luminescence current is $Ids=K*(PVDD-VDATA)^2$. Therefore, the voltage drop at the end far away from the IC causes a current drop.

Figure 2:
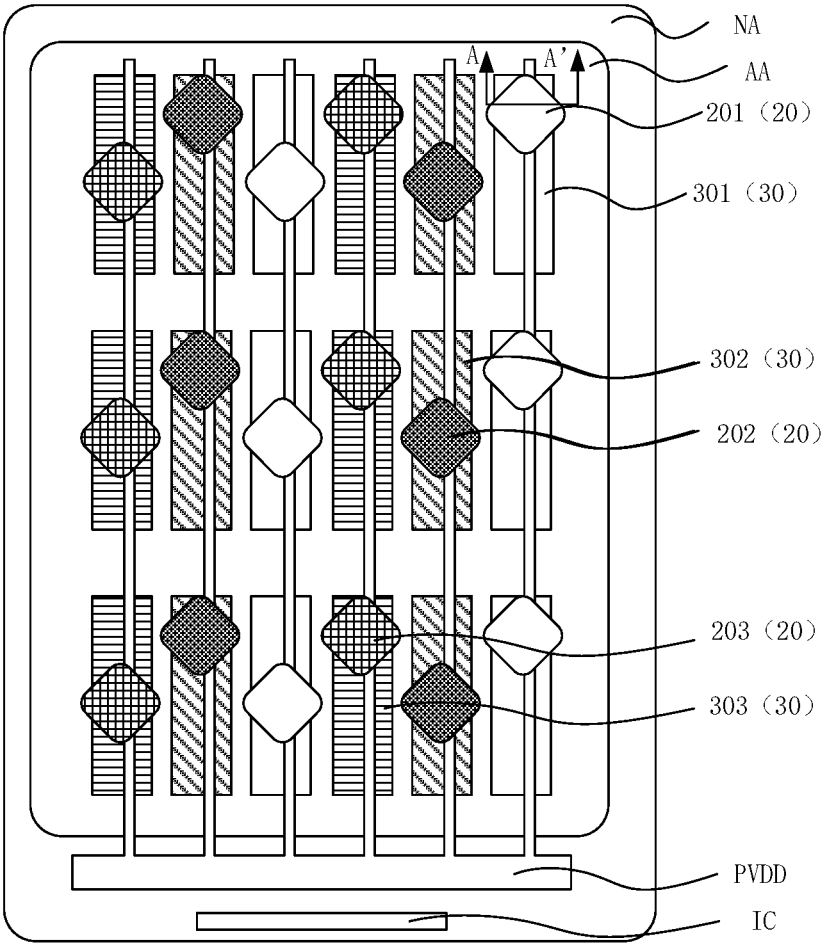
FIG. 2 is a schematic diagram of a display panel according to an embodiment of the present disclosure.
Figure 3:
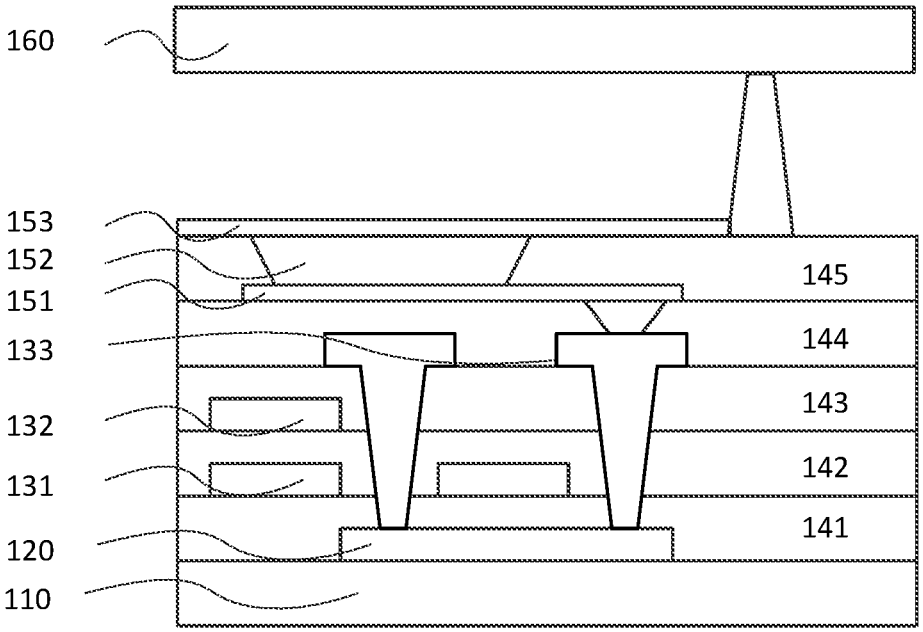
FIG. 3 is a sectional view of the display panel taken along line AA' in FIG. 2.
Figure 4:
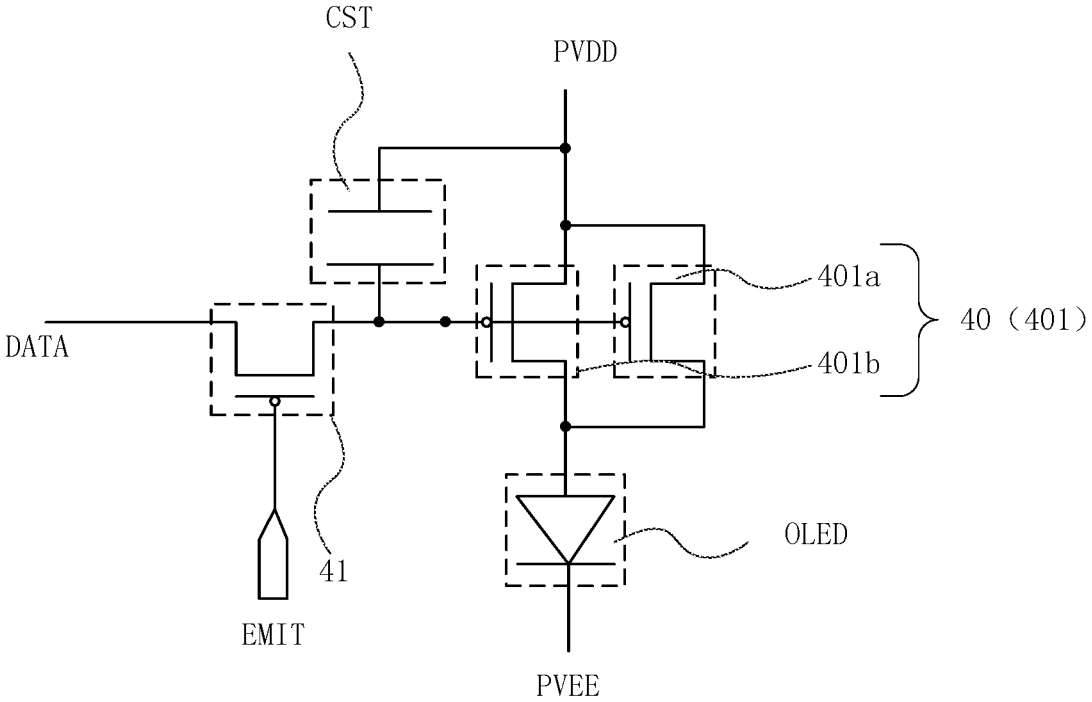
FIG. 4 is an equivalent circuit diagram of a first pixel driving circuit according to an embodiment of the present disclosure.
Figure 5:
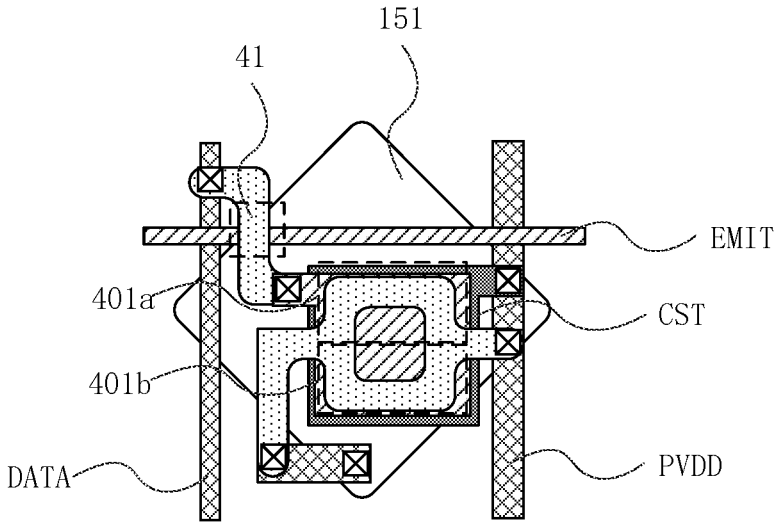
FIG. 5 is a layout diagram of the equivalent circuit in FIG. 4.
Figure 6:
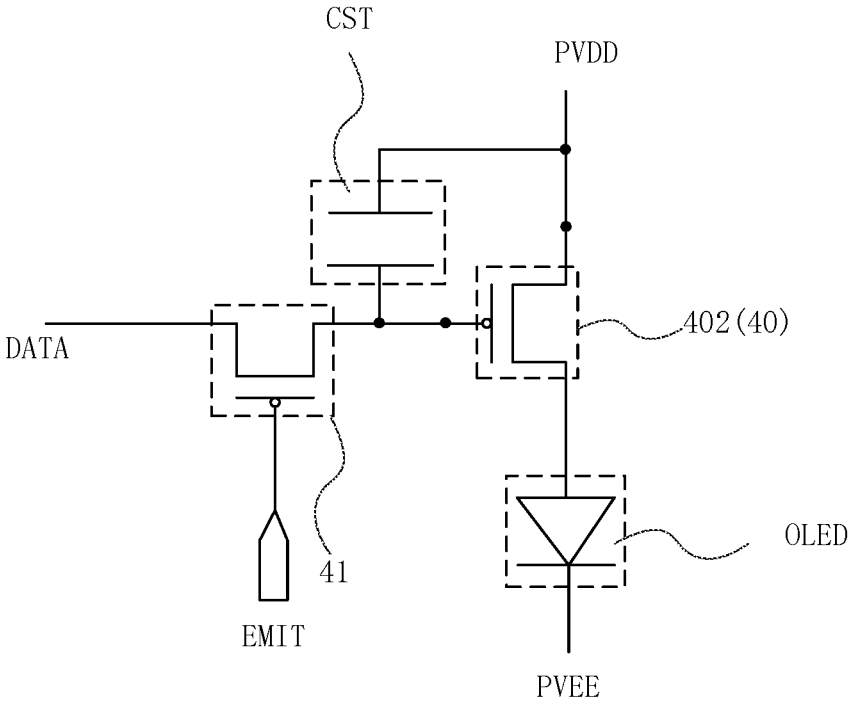
FIG. 6 is an equivalent circuit diagram of a second pixel driving circuit according to an embodiment of the present disclosure.
Figure 7:
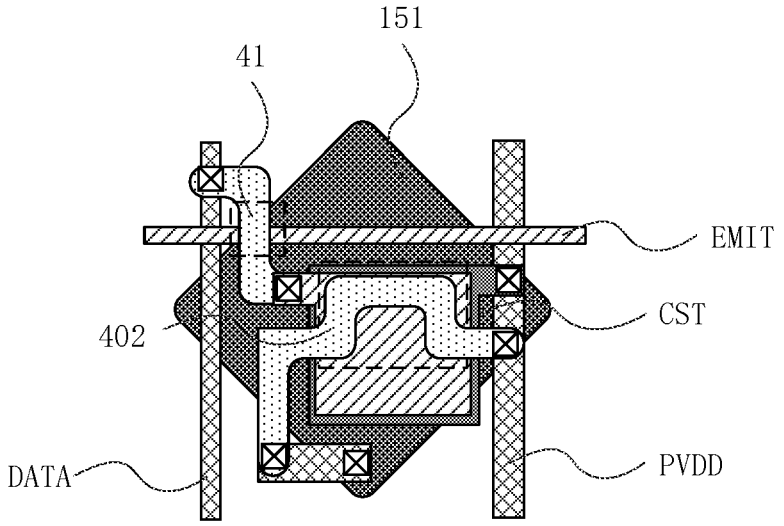
FIG. 7 is a layout diagram of the equivalent circuit in FIG. 6.
Figure 8:
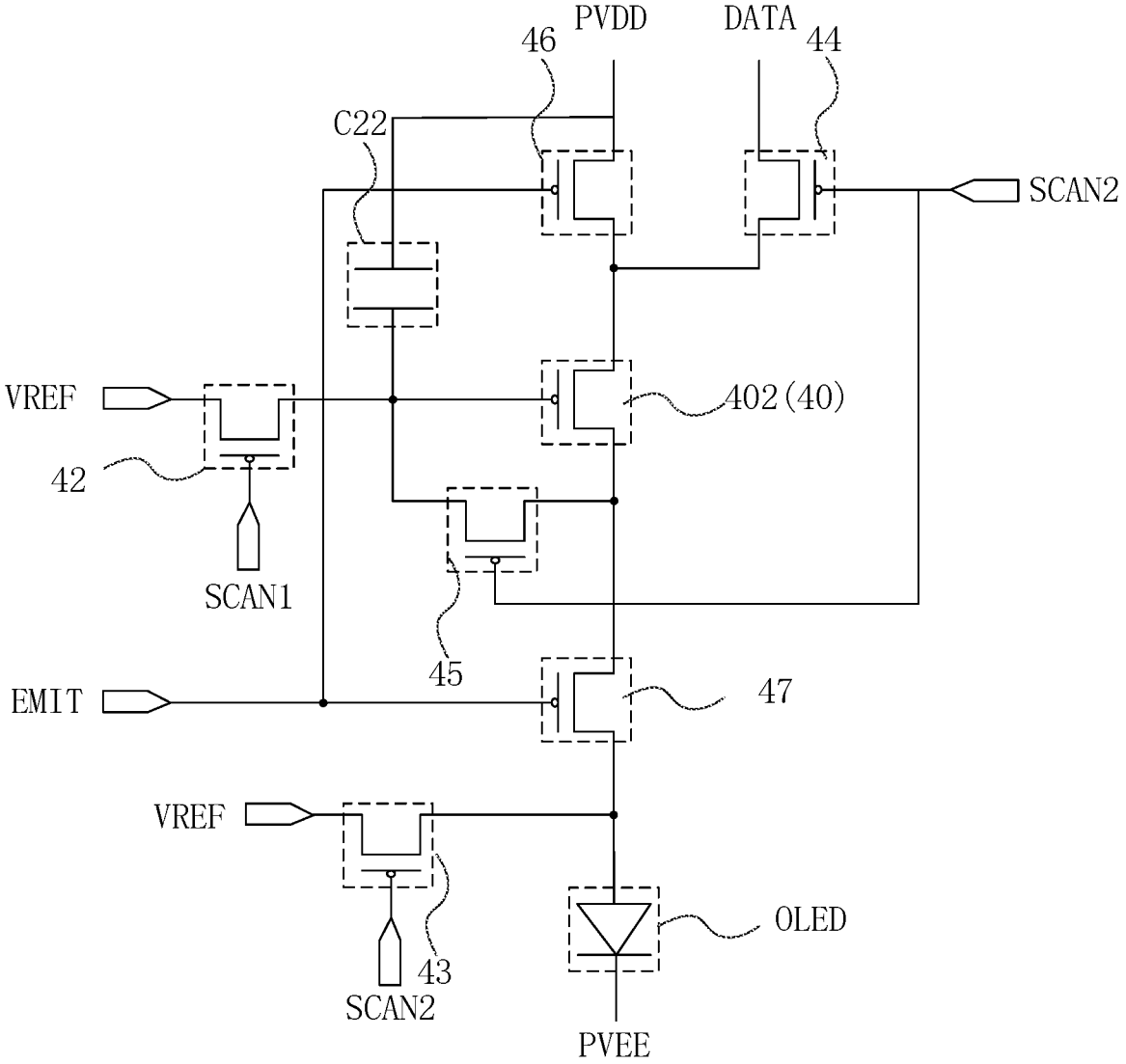
FIG. 8 is another equivalent circuit diagram of the second pixel driving circuit according to an embodiment of the present disclosure.

Some embodiments of the present disclosure provide a display panel that can solve problems mentioned above. FIG. 2 is a schematic diagram of a display panel according to an embodiment of the present disclosure; FIG. 3 is a sectional view of the display panel taken along line AA' in FIG. 2; FIG. 4 is an equivalent circuit diagram of a first pixel driving circuit according to an embodiment of the present disclosure; FIG. 5 is a layout diagram of the equivalent circuit in FIG. 4; FIG. 6 is an equivalent circuit diagram of a second pixel driving circuit according to an embodiment of the present disclosure; and FIG. 7 is a layout diagram of the equivalent circuit in FIG. 6.

Some embodiments of the present disclosure provide a display panel including sub-pixels 20 and pixel driving circuits 30 for driving the sub-pixels 20. The sub-pixels 20 include a first sub-pixel 201 and a second sub-pixel 202. The pixel driving circuits 30 include a first pixel driving circuit 301 and a second pixel driving circuit 302. The first pixel driving circuit 301 drives the first sub-pixel 201 and includes a first driving transistor 401, and the second pixel driving circuit 302 drives the second sub-pixel 202 and includes a second driving transistor 402. An operating current of the first sub-pixel 201 at a preset grayscale is n times an operating current of the second sub-pixel 202 at the preset grayscale, where $n\geq1.5$. Therefore, according to the Ids-Vgs curve of the driving transistor in FIG. 1, $\Delta V_1=\Delta V_2$ when the first sub-pixel and the second sub-pixel are equally distanced from the IC, and it can be seen clearly that $\Delta I_2>\Delta I_1$. Since the operating current of the first sub-pixel 201 is n times the operating current of the second sub-pixel at a preset grayscale, the first sub-pixel and the second sub-pixel can generate a same brightness difference when the current of the first sub-pixel 201 decreases to a current that is n times the current of the second sub-pixel. Since $\Delta I_2 > \Delta I_1$, a brightness reduction of the first sub-pixel 201 is far lower than a brightness reduction of the second sub-pixel 202 and then a ratio of brightness of the first sub-pixel 201 to the second sub-pixel 202 changes compared with the end near the IC, which causes a color cast. For example, a ratio of brightness of the first sub-pixel to the second sub-pixel at the end near the IC is 100 nit:100 nit. However, the brightness of the first sub-pixel is reduced by 10 nit due to a voltage drop at the end far away from the IC, and the brightness of the second sub-pixel is reduced by 20 nit due to a smaller operating current. Therefore, the ratio of brightness of the first sub-pixel to the second sub-pixel is 90 nit:80 nit at the end far away from the IC, and the relatively big change of the ratio of brightness results in a color cast. It is noted that, the preset grayscale herein can be any one or a part of display grayscales of a sub-pixel, for example, the preset grayscale is a maximum grayscale, or a grayscale greater than an average grayscale of the maximum grayscale and a minimum grayscale, or a part of grayscales between the average grayscale and the maximum grayscale. To summarize, the preset grayscale of the present disclosure refers to a grayscale corresponding to a maximum difference between the driving current of the first sub-pixel and the driving current of the second sub-pixel. In some embodiments, in order to solve the problem of the color cast, the first driving transistor 401 includes a first driving sub-transistor 401*a* and a second driving sub-transistor 401*b*. Agate electrode of the first driving sub-transistor 401*a* is electrically connected to a gate electrode of the second driving sub-transistor 401*b*, a first electrode of the first driving sub-transistor 401*a* is electrically connected to a first electrode of the second driving sub-transistor 401*b*, a second electrode of the first driving sub-transistor 401*a* is electrically connected to a second electrode of the second driving sub-transistor 401*b*, and the number of second driving transistors 402 is smaller than the number of first driving transistors 401. Since the operating current of the first sub-pixel 201 at the preset grayscale is n times the operating current of the second sub-pixel 202 at the preset grayscale, the first driving transistor 401 in the present disclosure includes at least two driving sub-transistors, i.e., the first driving sub-transistor 401*a* and the second driving sub-transistor 401*b*. Further, the first driving sub-transistor 401*a* and the second driving sub-transistor 401*b* are connected in parallel and gates thereof are connected to each other such that the operating current of the first sub-pixel 201 at a preset grayscale is divided into at least two portions that are respectively generated by the first driving sub-transistor 401*a* and the second driving sub-transistor 401*b*. Thus, operating currents flowing through the first driving sub-transistor 401*a* and the second driving sub-transistor 401*b* decrease, and then slopes of the Ids-Vgs curves of the driving transistors increase during their operating current ranges (increasing of the slope herein means that a tangent line is steeper, that is, an absolute value of the slope increases). The first driving sub-transistor 401*a* and the second driving sub-transistor 401*b* each generate a current drop that is higher than a current drop generated in a case where there is only one first driving transistor, such that the current drop corresponding to the first sub-pixel 201 is greater than the current drop corresponding to the second sub-pixel 202. In this way, a reduction value of brightness of the first sub-pixel 201 is substantially the same as a reduction value of brightness of the second sub-pixel 202, so that a ratio of brightness of the first sub-pixel 201 to the second sub-pixel 202 remains unchanged and the color cast is avoided.

In some embodiments of the present disclosure, the organic light-emitting display panel further includes a third sub-pixel 203 and a third pixel driving circuit 303 for driving the third sub-pixel 203. The third pixel driving circuit 303 includes a third driving transistor. An operating current of the third sub-pixel 203 at the preset grayscale is m times the operating current of the second sub-pixel 202 at the preset grayscale, where $0.9 \leq m \leq 1.1$. The number of third driving transistors is equal to the number of second driving transistors 402. Since a difference between the operating current of the third sub-pixel 203 at the preset grayscale and the operating current of the second sub-pixel 202 at the preset grayscale is not greater than 10%, a deviation of the reduction value of brightness is relatively small. And according to the Ids-Vgs curve in FIG. 1, it can be seen that the slope is substantially unchanged when the operating current is within a middle-low range. Therefore, a change of the ratio of brightness of the second sub-pixel 202 to the third sub-pixel 203 is relatively small, and the ratio of brightness of the second sub-pixel 202 to the third sub-pixel 203 can be maintained by setting that the number of second driving transistors is equal to the number of third driving transistors, thereby avoiding the color cast.

In an embodiment, an efficiency of a phosphorescent material is far higher than an efficiency of a fluorescent material, but a lifetime of the phosphorescent material is shorter than a lifetime of the fluorescent material. With the development of systems of materials, in order to ensure the lifetime of the blue sub-pixel, the blue sub-pixel is made of the fluorescent material. The lifetime of the red sub-pixel and the lifetime of the green sub-pixel are each longer than the lifetime of the blue sub-pixel, so the red sub-pixel and the green sub-pixel are made of the phosphorescent material with a higher efficiency. Accordingly, the blue sub-pixel has a lower efficiency and requires a greater driving current under a same grayscale. In an embodiment, the first sub-pixel 201 is the blue sub-pixel, the second sub-pixel 202 is the red sub-pixel and the third sub-pixel 203 is the green sub-pixel. The number of the second driving transistors is 1, the number of the third driving transistors are 1, and the number of the first driving transistors is 2. The two first driving transistors are the first driving sub-transistor 401*a* and the second driving sub-transistor 401*b*, respectively. In an embodiment, the first driving sub-transistor 401*a* and the second driving sub-transistor 401*b* are connected with each other in parallel so as to divide the operating current of the first sub-pixel 201 at the preset grayscale into at least two parts, e.g., one part generated by the first driving sub-transistor 401*a* and another part generated by the second driving sub-transistor 401*b*. Therefore, an operating current flowing through the first driving sub-transistor 401*a* and an operating current flowing through the second driving sub-transistor 401*b* are reduced and then slopes of their operating current ranges on the Ids-Vgs curve of the driving transistor b increase, which causes a current drop corresponding to the blue sub-pixel to be greater than both a current drop corresponding to the red sub-pixel and a current drop corresponding to the green sub-pixel, and a reduction value of brightness of the blue sub-pixel to be substantially the same as both a reduction value of brightness of the red sub-pixel and a reduction value of brightness of the green sub-pixel. A ratio of brightness of the blue sub-pixel to the red sub-pixel to the green sub-pixel remains unchanged, thereby avoiding the color cast.

In some embodiments, a driving current generated by the driving transistor is $I=\frac{1}{2}Cox\ \mu*W/L\ (Vgs-Vth)^2$, where Cox is a parameter related to the driving transistor, W/L is a width-to-length ratio of the driving transistor, Vgs is a voltage difference between a gate electrode and a source electrode of the driving transistor, and Vth is a threshold voltage of the driving transistor. In order to precisely control a current of the first driving transistor at the preset grayscale to be n times a current of the second driving transistor at the preset grayscale, in an embodiment, without changing other parameters of the driving transistors, a width-to-length ratio of the first driving sub-transistor 401*a* and a width-to-length ratio of the second driving sub-transistor 401*b* are set to control the current of the first driving transistor at the preset grayscale to be n times the current of the second driving transistor at the preset grayscale. In an embodiment, a width-to-length ratio of the first driving sub-transistor is $W_{1a}/L_{1a}$, a width-to-length ratio of the second driving sub-transistor is $W_{1b}/L_{1b}$, and a width-to-length ratio of the second driving transistor 402 is $W_2/L_2$, where $W_{1a}/L_{1a}+W_{1b}/L_{1b}=n*W_2/L_2$. Then according to an equation of the driving current, a total driving current generated by the first driving sub-transistor and the second driving sub-transistor which are connected in parallel to the first sub-pixel 201 is $I_1$, where $I_1=I_a+I_b=\frac{1}{2}Cox\ \mu*W_{1a}/L_{1a}\ (Vgs-Vth)^2+\frac{1}{2}Cox\ \mu*W_{1b}/L_{1b}\ (Vgs-Vth)^2=\frac{1}{2}Cox\ \mu(W_{1a}/L_{1a}+W_{1b}/L_{1b})*(Vgs-Vth)^2$. A current generated by the second sub-pixel 202 is $I_2$, where $I_2=\frac{1}{2}Cox\ \mu*W_2/L_2\ (Vgs-Vth)^2$. Since $W_{1a}/L_{1a}+W_{1b}/L_{1b}=n*W_2/L_2$, then $I_1=n*I_2$. Therefore, in the described embodiment, it is ensured that the driving current of the first sub-pixel 201 at the preset grayscale is n times the driving current of the second sub-pixel 202 at the preset grayscale. At the end that is far away from the IC, when a voltage drop $\Delta V$ is generated due to a resistance of a signal line, a current drop correspondingly generated by the first sub-pixel 201 is $\Delta I_3=\Delta I_a+\Delta I_b$, where $\Delta I_a$ represents a current drop caused by the first driving sub-transistor, and $\Delta I_b$ represents a current drop caused by the second driving sub-transistor. A current drop correspondingly generated by the second sub-pixel 202 is $\Delta I_4$, and the driving current for the first sub-pixel is generated respectively by the first driving sub-transistor 401*a* and the second driving sub-transistor 401*b*. Therefore, an operating current flowing through the first driving sub-transistor 401*a* and an operating current flowing through the second driving sub-transistor 401*b* decrease, and then slopes of their operating current ranges on the Ids-Vgs curve of the driving transistor increase. In this way, $\Delta I_3$ is substantially equivalent to n times $\Delta I_4$, which causes the current drop corresponding to the first sub-pixel 201 to be greater than the current drop corresponding to the second sub-pixel 202, and the reduction value of brightness of the first sub-pixel 201 to be substantially the same as the reduction value of brightness of the second sub-pixel 202. The ratio of brightness of the first sub-pixel 201 to the second sub-pixel 202 remains unchanged, thereby avoiding the color cast.

In an embodiment of the present disclosure, the first driving sub-transistor, the second driving sub-transistor, and the second driving transistor have a same length. Thus, for the first driving sub-transistor and the second driving sub-transistor, a driving current of the first driving sub-transistor and a driving current of the second driving sub-transistor are reduced without increasing layout space. A length $L_{1a}$ of the first driving sub-transistor 401*a* is equal to a length $L_{1b}$ of the second driving sub-transistor 401*b* and is also equal to a length $L_2$ of the second driving transistor 402, and $W_{1a}+W_{1b}=n*W_2$. According to this embodiment, $W_{1a}/L_{1a}+W_{1b}/L_{1b}=n*W_2/L_2$ and $I_1=n*I_2$. At the end that is far away from the IC, when the voltage drop $\Delta V$ is generated by the resistance on the signal line, a current drop generated corresponding to the first sub-pixel 201 is $\Delta I_3=\Delta I_a+\Delta I_b$, where $\Delta I_a$ represents a current drop caused by the first driving sub-transistor; and $\Delta I_b$ represents a current drop caused by the second driving sub-transistor. A current drop generated corresponding to the second sub-pixel 202 is $\Delta I_4$. Since the driving current for the first sub-pixel is generated respectively by the first driving sub-transistor 401*a* and the second driving sub-transistor 401*b*, the operating current flowing through the first driving sub-transistor 401*a* and the operating current flowing through the second driving sub-transistor 401*b* decrease, and then slopes of their operating current ranges on the Ids-Vgs curve of the driving transistor increase. Thus, $\Delta I_3$ is substantially equivalent to $n*\Delta I_4$, so that a current drop corresponding to the first sub-pixel 201 is greater than a current drop corresponding to the second sub-pixel 202, and a reduction value of brightness of the first sub-pixel 201 and a reduction value of brightness of the second sub-pixel 202 are substantially the same. Therefore, a ratio of brightness of the first sub-pixel 201 to the second sub-pixel 202 remains unchanged and therefore the color cast is avoided.

In another embodiment of the present disclosure, the first driving sub-transistor, the second driving sub-transistor, and the second driving transistor have a same width. A width $W_{1a}$ of the first driving sub-transistor 401*a* is equal to a width $W_{1b}$ of the second driving sub-transistor 401*b* and is also equal to a width $W_2$ of the second driving transistor 402, and $L_{1a}*L_{1b}/(L_{1a}+L_{1b})=L_2/n$. According to this embodiment, $W_{1a}/L_{1a}+W_{1b}/L_{1b}=n*W_2/L_2$ and $I_1=n*I_2$. At the end far away from the IC, when a voltage drop $\Delta V$ is generated by the resistance on the signal line, the current drop generated corresponding to the first sub-pixel 201 is $\Delta I_3=\Delta I_a+\Delta I_b$, where $\Delta I_a$ represents a current drop caused by the first driving sub-transistor; and $\Delta I_b$ represents a current drop caused by the second driving sub-transistor. The current drop corresponding to the second sub-pixel 202 is $\Delta I_4$. Since the driving current for the first sub-pixel is generated respectively by the first driving sub-transistor 401*a* and the second driving sub-transistor 401*b*, the operating current flowing through the first driving sub-transistor 401*a* and the operating current flowing through the second driving sub-transistor 401*b* decrease, and then slopes of their operating current ranges on the Ids-Vgs curve of the driving transistor increases. Thus, $\Delta I_3$ is substantially equivalent to $n*\Delta I_4$, so that the current drop corresponding to the first sub-pixel 201 is greater than the current drop corresponding to the second sub-pixel 202, and the reduction value of brightness of the first sub-pixel 201 and the reduction value of brightness of the second sub-pixel 202 are substantially the same. Therefore, the ratio of brightness of the first sub-pixel 201 to the second sub-pixel 202 remains unchanged and therefore the color cast is avoided.

In another embodiment of the present application, n=2, the operating current $I_1$ of the first sub-pixel 201 at the preset grayscale is twice the operating current $I_2$ of the second sub-pixel 202 at the preset grayscale, $W_{1a}/L_{1a}=W_2/L_2$, and $W_{1b}/L_{1b}=W_2/L_2$. The width-to-length ratio of the first driving sub-transistor 401*a*, the width-to-length ratio of the second driving sub-transistor 401*b*, and the width-to-length ratio of the second driving transistor 402 are the same in this embodiment. According to this embodiment, since the operating current of the first sub-pixel 201 is twice the second sub-pixel 202, i.e., $I_1=2*I_2$, and the first sub-driving transistor 401*a* and the second sub-driving transistor 401*b* have the same width-to-length ratio, then each of the currents flowing through the first sub-driving transistor 401*a* and through the second sub-driving transistor 401*b* is half of the operating current of the first sub-pixel 201, that is, 1/2 $I_1$. Because $I_1=2*I2$, then each of the driving current flowing through the first sub-driving transistor 401*a* and the driving current flowing through the second sub-driving transistor 401*b* is $I_2$. According to $I=½Cox\ \mu*W/L\ (Vgs-Vth)^2$, $W_{1a}/L_{1a}=W_2/L_2$ and $W_{1b}/L_{1b}=W_2/L_2$, the driving current flowing through the second driving transistor is also $I_2$. Because the three transistors have the same width-to-length ratio, then Ids-Vgs curves of the three transistors coincide with each other. In addition, since driving currents of the first driving sub-transistor 401*a*, the second driving sub-transistor 401*b* and the second driving transistor 402 are the same, their slopes within the operating current range are the same. Therefore, the first driving sub-transistor 401*a*, the second driving sub-transistor 401*b* and the second driving transistor 402 generate the same current drop under a same voltage drop, that is, $\Delta I_a=\Delta I_b=\Delta I_4$, where $\Delta I_a$ represents the current drop caused by the first driving sub-transistor, $\Delta I_b$ represents the current drop caused by the second driving sub-transistor, and $\Delta I_4$ represents the current drop caused by the second driving transistor. Therefore, the current drop of the first sub-pixel 201 is an addition of current drops of the first driving sub-transistor 401*a* and the second driving sub-transistor 401*b*, and the current drop corresponding to the first sub-pixel 201 is twice the current drop of the second sub-pixel 202. Further, because the operating current of the first sub-pixel 201 at the preset grayscale is twice the operating current of the second sub-pixel 202 at the preset grayscale, the reduction value of brightness of the first sub-pixel is the same as the reduction value of brightness of the second sub-pixel, so that the ratio of brightness of the first sub-pixel 201 to the second sub-pixel 202 remains unchanged and thus the color cast is avoided.

In another embodiment of the present disclosure, n=1.5, i.e., the operating current of the first sub-pixel 201 at the preset grayscale is 1.5 times the operating current of the second sub-pixel 202 at the preset grayscale; $W_{1a}/L_{1a}=0.5W_2/L_2$, and $W_{1b}/L_{1b}=W_2/L_2$; or, $W_{1a}/L_{1a}=W_2/2*L_2$, and $W_{1b}/L_{1b}=W_2/L_2$. In addition, according to $I=½Cox\ \mu*W/L\ (Vgs-Vth)^2$, then $I_1=1.5*I_2$, and $2*I_a=I_b=I_2$, where $I_a$ is a driving circuit generated by the first driving sub-transistor; $I_b$ is a driving current generated by the second driving sub-transistor, and $I_2$ is a driving current generated by the second driving transistor. According to the foregoing analysis, the second driving sub-transistor 401*b* and the second driving transistor 402 can generate a same current drop, the width-to-length ratio of the first driving sub-transistor is half of the width-to-length ratio of the second driving sub-transistor, the current drop of the first driving sub-transistor 401*a* is half of the current drop of the second driving sub-transistor 401*b*, and the current drop of the first sub-pixel 201 is 1.5 times the current drop of the second sub-pixel 202. Further, since the operating current of the first sub-pixel 201 at the preset grayscale is 1.5 times the operating current of the second sub-pixel 202 at the preset grayscale, the reduction values of brightness of the first sub-pixel 201 is substantially equivalent to the reduction value of brightness of the second sub-pixel 202, so that the ratio of brightness of the first sub-pixel 201 to the second sub-pixel 202 remains unchanged and thus the color cast is avoided.

In another embodiment of the present disclosure, n=1.5, i.e., the operating current of the first sub-pixel 201 at the preset grayscale is 1.5 times the operating current of the second sub-pixel 202 at the preset grayscale; $W_{1a}/L_{1a}=0.75*W_2/L_2$, and $W_{1b}/L_{1b}=0.75*W_2/L$. In addition, according to $I=½Cox\ \mu*W/L\ (Vgs-Vth)^2$, $I_1=1.5*I_2$, and $I_a=I_b=0.75*I_2$. The first driving sub-transistor 401*a* and the second driving sub-transistor 401*b* can generate a same current drop, and therefore the current drop of the first sub-pixel 201 is 1.5 times the current drop of the second sub-pixel 202. Further, since the operating current of the first sub-pixel 201 at the preset grayscale is 1.5 times the operating current of the second sub-pixel 202 at the preset grayscale, the reduction value of brightness of the first sub-pixel 201 is substantially equivalent to the reduction value of brightness of the second sub-pixel 202, so that the ratio of brightness of the first sub-pixel 201 to the second sub-pixel 202 remains unchanged and thus the color cast is avoided. In this embodiment, the gate electrode of the first driving sub-transistor 401*a* is electrically connected to the gate electrode of the second driving sub-transistor 401*b*; the first electrode of the first driving sub-transistor 401*a* is electrically connected to the first electrode of the second driving sub-transistor 401*b*; and a second electrode of the first driving sub-transistor 401*a* is electrically connected to the second electrode of the second driving sub-transistor 401*b*. That is, the first driving sub-transistor 401*a* and the second driving sub-transistor 401*b* are connected in parallel, and in addition, the first driving sub-transistor 401*a* and the second driving sub-transistor 401*b* have the same width-to-length ratio, such that the threshold voltage of the first driving sub-transistor 401*a* and the threshold voltage of the second driving sub-transistor 401*b* are the same, and can be compensated simultaneously.

In another embodiment of the present disclosure, referring to FIGS. 4 to 7, the pixel driving circuit includes a driving transistor 40, a first power supply voltage terminal PVDD, and a storage capacitor CST.

In the illustrated embodiment, the first electrode of the driving transistor 40 is connected to the first power voltage terminal PVDD, a gate electrode of the driving transistor 40 is connected to a first terminal of the storage capacitor CST, the second electrode of the driving transistor 40 is connected to the sub-pixels, and a second terminal of the storage capacitor CST is electrically connected to the first power supply voltage terminal PVDD.

Referring to FIG. 3, the display panel can further include a substrate 110, and on the substrate 110, sequentially, an active layer 120, a gate insulating layer 141, a gate metal layer 131, a first interlayer insulating layer 142, a capacitor metal layer. 132, a second interlayer insulating layer 143, a source/drain metal layer 133, a planarization layer 144, a first electrode 151, and a pixel defining layer 145. The pixel defining layer 145 is formed with an opening, and an organic light-emitting material layer 152 is formed in the opening of the pixel defining layer. Finally, a second electrode 153 is formed to cover the organic light-emitting material layer 152. The transistors and capacitors in the embodiments of the present disclosure can include the above-described semiconductor layer, metal conductive layer, and an insulating layer there between.

Figure 9:
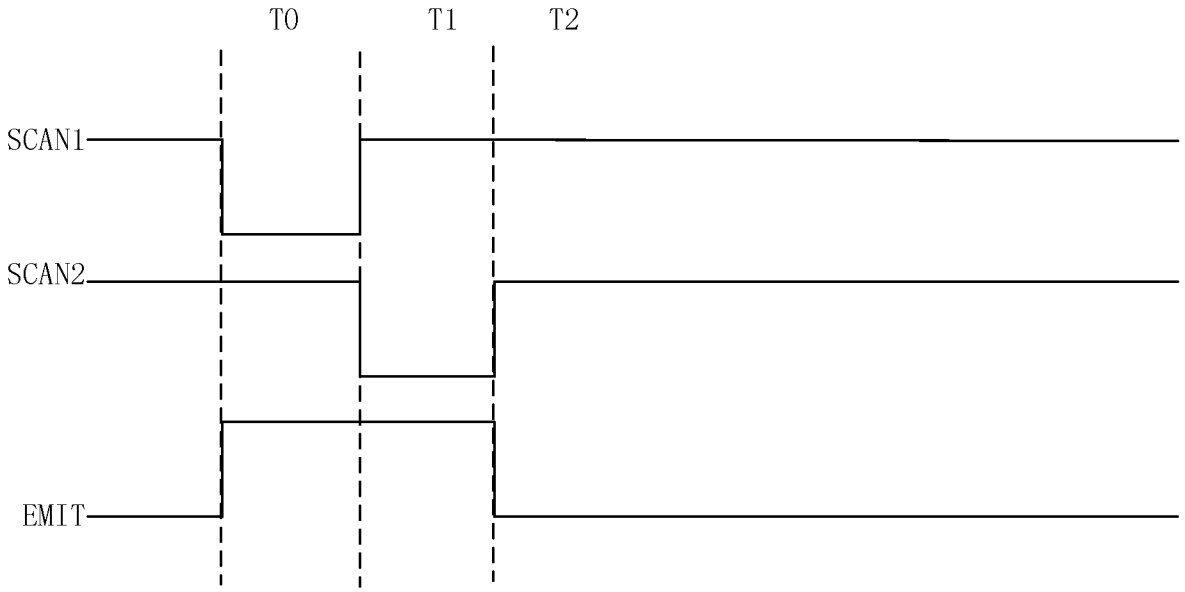
FIG. 9 is a timing diagram of the equivalent circuit diagram in FIG. 8.
Figure 10:
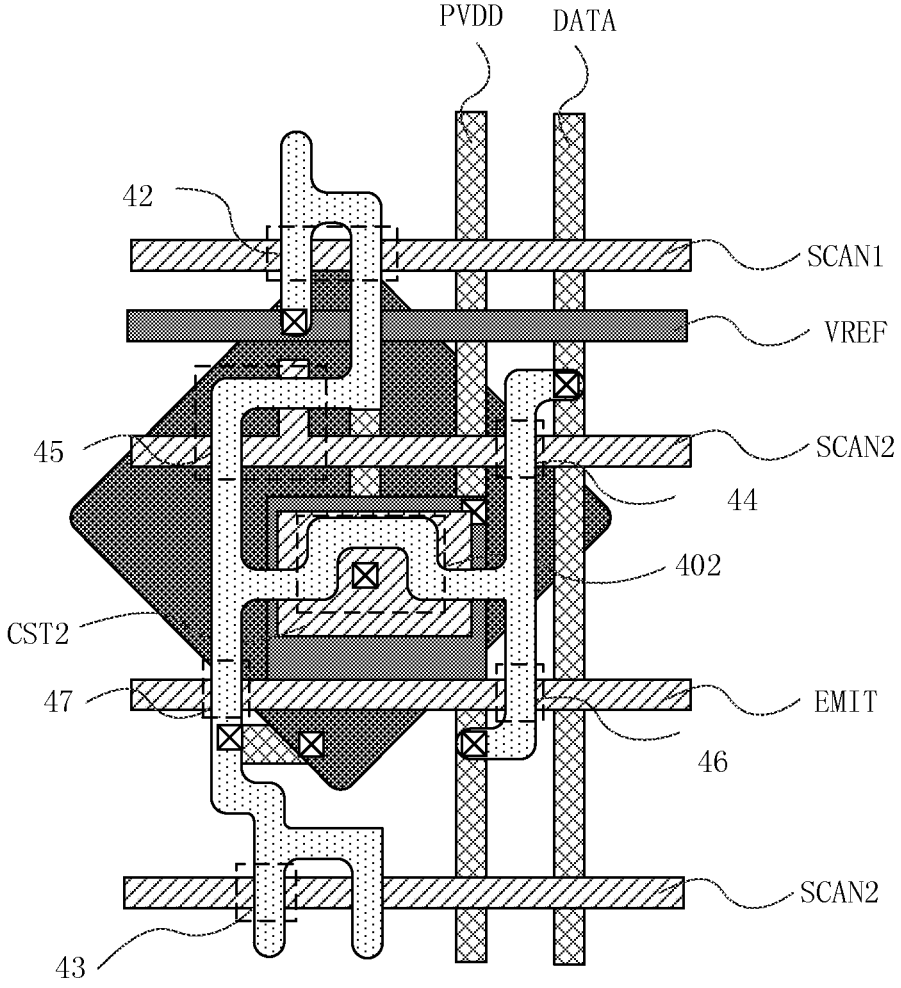
FIG. 10 is a layout diagram of the equivalent circuit in FIG. 8.

In another embodiment of the present application, referring to FIGS. 8-14, FIG. 8 is another equivalent circuit diagram of the second pixel driving circuit according to an embodiment of the present disclosure; FIG. 9 is a timing diagram of the equivalent circuit diagram in FIG. 8; FIG. 10 is a layout diagram of the equivalent circuit in FIG. 8; FIG.

Figure 12:
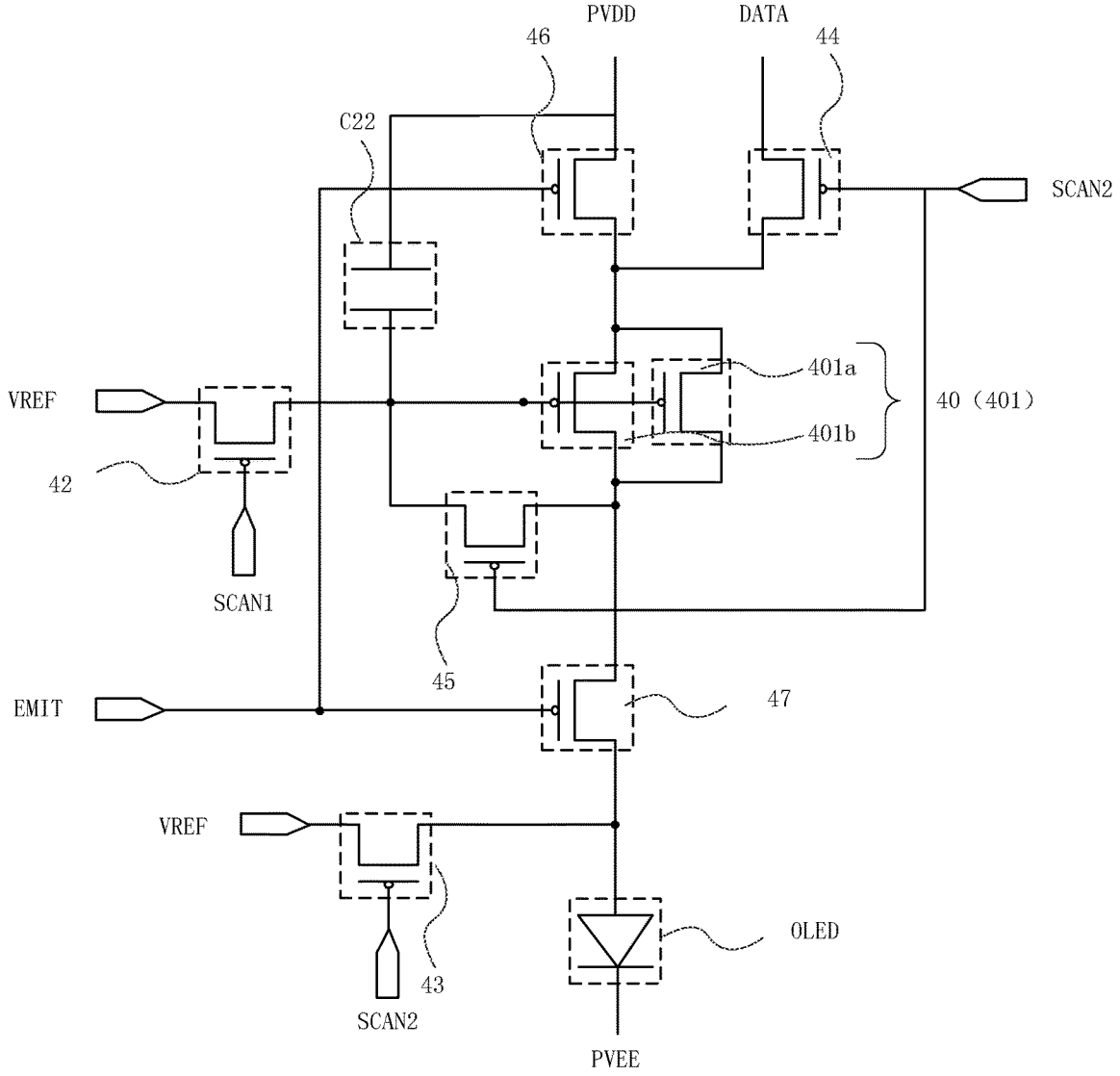
FIG. 12 is an equivalent circuit diagram of a first pixel driving circuit according to an embodiment of the present disclosure.
Figure 13:
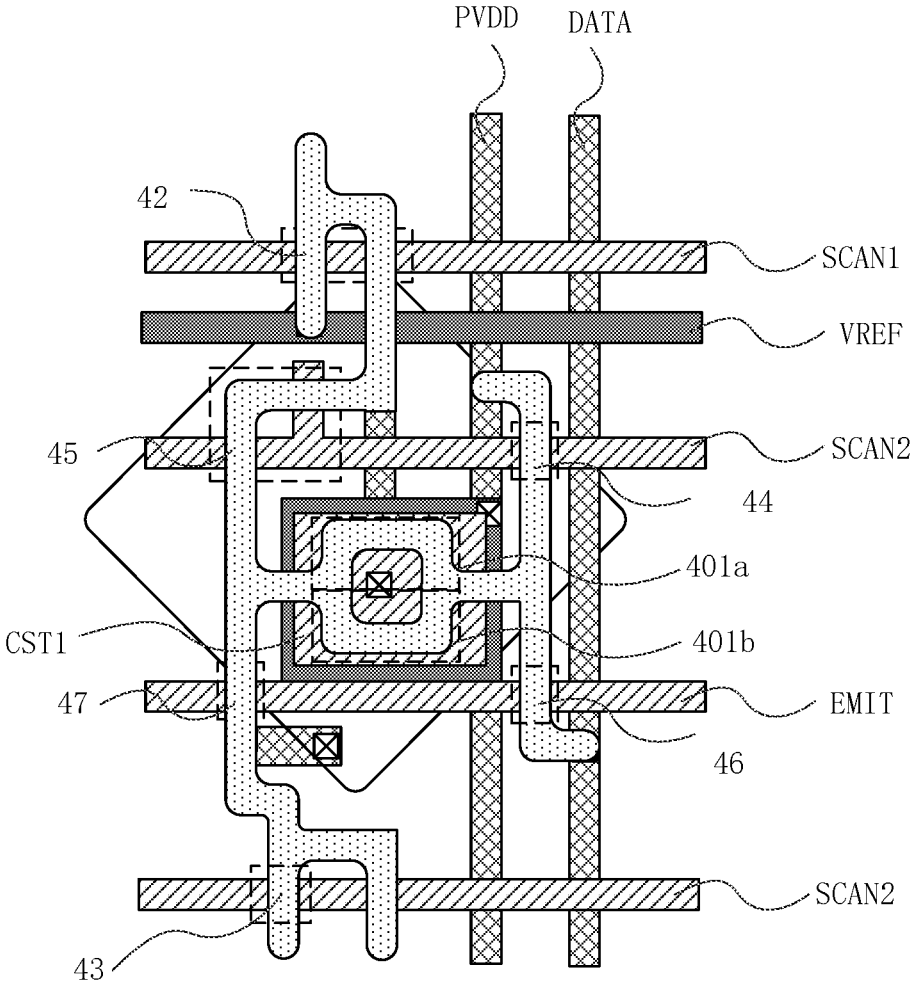
FIG. 13 is a layout diagram of the equivalent circuit in FIG. 12.
Figure 14:
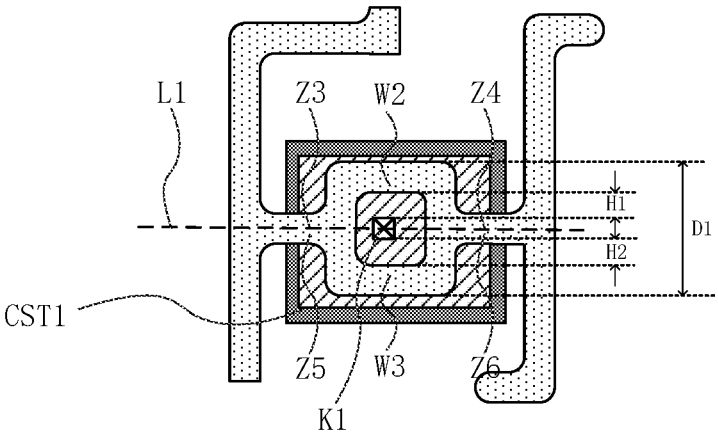
FIG. 14 is a local enlarged view of FIG. 13.

11 is a local enlarged view of FIG. 10; FIG. 12 is an equivalent circuit diagram of a first pixel driving circuit according to an embodiment of the present disclosure; FIG. 13 is a layout diagram of the equivalent circuit in FIG. 12; and FIG. 14 is a local enlarged view of FIG. 13.

The pixel driving circuit 30 further includes an initialization signal terminal VREF, a data signal terminal DATA, a gate initialization transistor 42, an anode initialization transistor 43, a data writing transistor 44, a power supply voltage writing transistor 46, a compensation transistor 45 and a light-emitting control transistor 47. The gate initialization transistor 42 is connected in series between the initialization signal terminal VREF and the gate electrode of the driving transistor 40 and is configured to transmit an initialization signal REF to the gate electrode of the driving transistor under a control of a first scanning control signal SCAN1. The anode initialization transistor 43 is connected in series between the initialization signal terminal VREF and the anode of the sub-pixels and is configured to transmit the initialization signal REF to the anode of the sub-pixels under a control of the first scanning control signal SCAN1 or a second scanning control signal SCAN2. The data writing transistor 44 is connected in series between the data signal terminal DATA and the first electrode of the initialization transistor 42 and is configured to transmit a data signal VDATA to the gate electrode of the driving transistor 40 under a control of the second scanning control signal SCAN2. The compensation transistor 45 is connected in series between the second electrode and the gate electrode of the driving transistor 40 and is configured to compensate a deviation of a threshold voltage of the driving transistor 40 under the control of the second scanning control signal SCAN2. The power supply voltage writing transistor 46 is connected in series between the first power supply voltage terminal PVDD and the first electrode of the driving transistor 40 and is configured to transmit a first power supply voltage VDD to the gate electrode of the driving transistor 40 under a control of a light-emitting control signal EMIT. The light-emitting control transistor 47 is connected in series between the second electrode of the driving transistor 40 and the anode of the sub-pixels and is configured to transmit a driving current generated by the driving transistor 40 to the sub-pixels under a control of the light-emitting control signal EMIT.

During an initialization period T0, the first scanning control signal SCAN1 is at an effective level, and the second scanning control signal SCAN2 and the light-emitting control signal EMIT are at a cut-off level. The effective level herein refers to a level that can make the controlled transistor be in a turn-on state. For example, in a pixel driving circuit of a PMOS type, the effective level is a low level. The gate initialization transistor 42 is turned on and transmits the initialization signal REF to both the driving transistor 40 and an organic light-emitting element OLED to reset the driving transistor 40 and the organic light-emitting element OLED.

During a data writing period T1, the second scanning control signal SCAN2 is at an effective level, and the first scanning control signal SCAN1 and the light-emitting control signal EMIT are at a cut-off level; the data writing transistor 44 writes the data signal VDATA into a node of the gate electrode of the driving transistor 40. At this time, the compensation transistor T5 is also in a turn-on state, the data signal VDATA is transmitted to the gate electrode of the driving transistor 40 through the first electrode of the data writing transistor 44, the driving transistor 40 and the compensation transistor 45, a potential REF stored at a previous moment in the gate electrode of the driving transistor is elevated until the potential of the gate electrode of the driving transistor is VDATA-Vth, and then the driving transistor 40 is turned off. At this moment, the potential of the gate electrode of the driving transistor is VDATA-Vth, where Vth is the threshold voltage of the driving transistor. Due to variability in the manufacturing process of the transistors, the threshold voltages of transistors on the display panel are different even if the same process parameters are adopted to manufacturing the transistors, and as the use time increases, the threshold voltage of the transistor also drifts because of aging, which causes different positions of the display panel to have different brightness even if a same data signal is written in the different positions, thus causing uneven display and color drift. In the present embodiment, the threshold voltage of the driving transistor 40 is collected and stored in the gate electrode of the driving transistor so as to eliminate an influence of the threshold voltage on the luminescence brightness.

During a light-emitting period T2, the light-emitting control signal EMIT is at an effective level, and the first scanning control signal SCAN1 and the second scanning control signal SCAN2 are at a cut-off level; the power voltage writing transistor 46 is turned on, and the first power supply voltage VDD is transmitted to the first electrode of the driving transistor 40 to make the driving transistor 40 generate a driving current; and the light-emitting control transistor 47 is turned on to transmit the driving current to the organic light-emitting element OLED. The driving current generated by the driving transistor DT is Ids=½Cox μ*W/L*(Vsg−Vth)^2=½Cox μ*W/L*(VDD−(VDATA−Vth)−Vth)^2=½Cox μ*W/L*(VDD-VDATA)^2. It can be seen that, after a compensation during the data writing period T1, a luminescence current in the present embodiment depends on the written data signal, and is independent to the threshold voltage of the driving transistor 40, thereby eliminating the effect of unevenness and drifting of the threshold voltage of the driving transistor on the luminescence current.

In an embodiment, referring to FIG. 12 and FIG. 13, the gate electrode of the first driving sub-transistor 401*a* is electrically connected to the gate electrode of the second driving sub-transistor 401*b*; the first electrode of the first driving sub-transistor 401*a* is electrically connected to the first electrode of the second driving sub-transistor 401*b*; a second electrode of the first driving sub-transistor 401*a* is electrically connected to the second electrode of the second driving sub-transistor 401*b*; that is, the first driving sub-transistor 401*a* and the second driving sub-transistor 401*b* are connected in parallel. Further, the first driving sub-transistor 401*a* and the second driving sub-transistor 401*b* have the same width-to-length ratio such that the threshold voltages thereof are the same. Moreover, since the two are closely adjacent to each other and are always in a same voltage environment (gate electrodes, source electrodes and drain electrodes of the two are in the same voltage environment), the threshold voltages of the two have a same drift, and thus the threshold voltages of the first driving sub-transistor 401*a* and the second driving sub-transistor 401*b* can be compensated simultaneously.

In another embodiment of the present disclosure, the first pixel driving circuit 301 includes a first storage capacitor CST1, and the second pixel driving circuit 302 includes a second storage capacitor CST2. A capacitance of the first storage capacitor CST1 is greater than a capacitance of the second storage capacitor CST2. Since the driving current of the first sub-pixel 201 is greater, an area of the first sub-pixel is set to be larger in order to ensure that a lifetime of the first sub-pixel approximates a lifetime of the second sub-pixel. Additionally, a charging time of the first sub-pixel is shorter. In this embodiment, the setting that the capacitance of the first storage capacitor CST1 is greater than the capacitance of the second storage capacitor CST2 can reduce a leakage current of the first sub-pixel.

Figure 11:
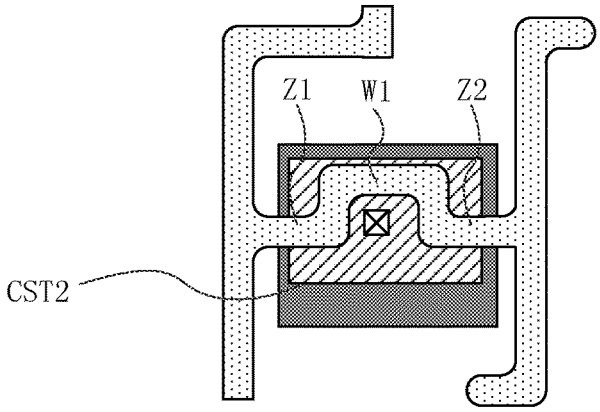
FIG. 11 is a local enlarged view of FIG. 10.

In an embodiment, referring to FIG. 11 and FIG. 14, the second driving transistor 402 includes a first linear portion Z1, a first bending portion W1 and a second linear portion Z2, which are connected to each other.

The first driving sub-transistor 401*a* includes a third linear portion Z3, a second bending portion W2, and a fourth linear portion Z4, which are connected to each other. The second driving sub-transistor 401*b* includes a fifth linear portion Z5, a third bending portion W3 and the sixth linear portion Z6, which are connected to each other. The third bending portion W3 and the second bending portion W2 are axisymmetric to each other about an extending line of the third linear portion Z3. The fifth linear portion Z5 is used as the third linear portion Z3 and the sixth linear portion Z6 is used as the fourth linear portion Z4. The layouts of the first driving sub-transistor 401*a* and the second driving sub-transistor 401*b* in the present embodiment allows to design the width-to-length ratios of the two in a limited space to improve the utilization of the space. Such symmetrical distribution facilitates setting the width-to-length ratios of the two to be consistent, such that the two can be compensated simultaneously. Further referring to FIG. 12 and FIG. 9, in the data writing phase T1, the data signal VDATA is written into the gate electrode through the first driving sub-transistor 401*a* and the second driving sub-transistor 401*b*, respectively. In a case where the threshold voltage of the first sub-driving transistor 401*a* is $Vth_a$, the threshold voltage of the second driving sub-transistor 401*b* is $Vth_b$, and $Vth_a<Vth_b$, when the potential of the gate electrode of the driving transistor is $VDATA-Vth_a$, the first driving sub-transistor 401*a* is turned off, but the data signal VDATA can still be transmitted from the second driving sub-transistor 401*b* to the gate electrode of the driving transistor; and when the potential of the gate electrode of the driving transistor is $VDATA-Vth_b$, the second driving sub-transistor is turned off, and the compensation is completed. However, at this time, only the threshold voltage of the second driving sub-transistor 401*b* is compensated, and the first driving sub-transistor 401*a* is not correctly compensated. Therefore, in this embodiment, it is set that the first driving sub-transistor 401*a* and the second driving sub-transistor 401*b* have a same width-to-length ratio, so that the threshold voltages of the two are the same and the two can be correctly compensated simultaneously.

In some embodiments, the first driving sub-transistor 401*a* and the second driving sub-transistor 401*b* are axisymmetric to each other about an axis of symmetry L1, the axis of symmetry L1 being the extending line of the third linear portion. The first driving sub-transistor 401*a* and the second driving sub-transistor 401*b* can have a same shape, which, not only from parameters but also from manufacturing processes, maintains a same drift of the threshold voltage of the two for a long using time, and therefore allows both sub-transistors to be compensated correctly. The symmetrical design occupies less space in the layout than does a translation design, and facilitates the uniform design of each of the first pixel driving circuit and the second pixel driving circuit.

In some embodiments, in order to improve a consistency of the first driving sub-transistor 401*a* and the second driving sub-transistor 401*b* so as to allow the first sub-driving transistor 401*a* and the second sub-driving transistor 401*b* to have the same threshold voltage drift, a maximum distance between the second bending portion W2 and the third bending portion W3 is smaller than a preset threshold. The pixel driving circuit 30 is made of a low temperature poly-silicon semiconductor, and the preset threshold is equal to a step value of laser crystallization for the low temperature poly-silicon semiconductor. Semiconductor layers of the first driving sub-transistor and the second driving sub-transistor are subjected to a same laser crystallization treatment by laser with a same degree of crystallization, so that parameters of the first driving sub-transistor and the driving sub-transistor are the same.

In another embodiment of the present disclosure, the first pixel driving circuit 301 includes a first storage capacitor CST1. The first storage capacitor CST1 includes a first electrode plate located in a gate electrode layer and a second electrode plate located in the capacitor metal layer. The first electrode plate serves as a gate electrode of the first driving transistor 401. In order to make a potential of the gate electrode of the first driving sub-transistor 401*a* and a potential of the gate electrode of the second driving sub-transistor 401*b* identical so as to allow a same threshold voltage shift of the two, it is set that the second electrode plate includes a first via hole K1, a second electrode of the gate initialization transistor includes a connection portion located in a source/drain metal layer, and the connection portion is electrically connected to the first electrode plate through the first via hole K1. A distance H1 between the first via hole K1 and the first driving sub-transistor is equal to a distance H2 between the first via hole K1 and the second driving sub-transistor. Therefore, potentials of gate electrodes for the two sub-transistors are identical, threshold voltages of the two are identical, and then the two can be correctly compensated simultaneously.

Figure 15:
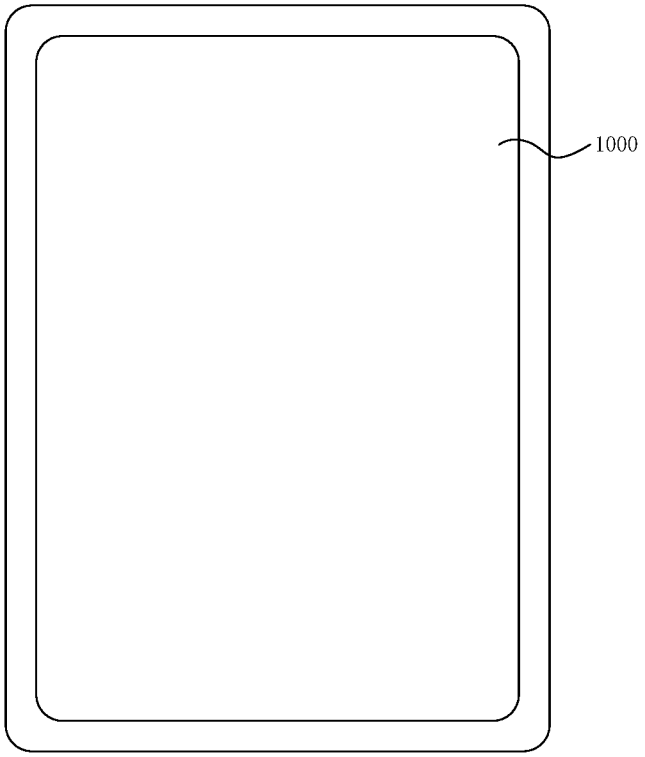
FIG. 15 is a schematic diagram of a display device according to an embodiment of the present disclosure.

Referring to FIG. 15, FIG. 15 is a schematic diagram of a display device according to an embodiment of the present disclosure. The display device of the present disclosure can include the organic light-emitting display panel above and includes, but is not limited to, cellular mobile telephones 1000, tablet PC, displays for computers, displays applied in smart wearable devices, display devices applied in vehicles such as automobiles, and the like. As long as a display device includes the organic light-emitting display panel included in the display device disclosed in the present disclosure, it shall fall within the scope of protection of the present disclosure.

The above are merely some embodiments of the present disclosure, and are not intended to limit the present disclosure. Any modifications, equivalents, improvements, etc., made within the principles of the present invention, should be included in the protection scope of the present disclosure.

What is claimed is:

1. An organic light-emitting display panel, comprising sub-pixels and pixel driving circuits for driving the sub-pixels;

wherein the sub-pixels comprise a first sub-pixel, a second sub-pixel, and a third sub-pixel, and the pixel driving circuits comprise a first pixel driving circuit, a second pixel driving circuit, and a third pixel driving circuit;

wherein the first pixel driving circuit comprises first driving transistors and is configured to drive the first sub-pixel, the second pixel driving circuit comprises one or more second driving transistors and is configured to drive the second sub-pixel, and the third pixel driving circuit comprises one or more third driving transistors and is configured to drive the third sub-pixel;

wherein an operating current of the first sub-pixel at a preset grayscale is n times an operating current of the second sub-pixel at the preset grayscale, where $n \geq 1.5$;

wherein the first driving transistors comprise a first driving sub-transistor and a second driving sub-transistor, wherein a gate electrode of the first driving sub-transistor is electrically connected to a gate electrode of the second driving sub-transistor; a first electrode of the first driving sub-transistor is electrically connected to a first electrode of the second driving sub-transistor; a second electrode of the first driving sub-transistor is electrically connected to a second electrode of the second driving sub-transistor; and a number of transistors of the one or more second driving transistors is smaller than a number of transistors of the first driving transistors; and wherein an operating current of the third sub-pixel at the preset grayscale is m times the operating current of the second sub-pixel at the preset grayscale, where $0.9 \leq m \leq 1.1$; and a number of transistors of the one or more third driving transistors is equal to the number of transistors of the one or more second driving transistors.

2. The organic light-emitting display panel according to claim 1, wherein the first sub-pixel is a blue sub-pixel, and the second sub-pixel and the third sub-pixel are a red sub-pixel and a green sub-pixel, respectively;

wherein both the number of transistors of the one or more second driving transistors and the number of transistors of the one or more third driving transistors is one; and wherein the number of transistors of the first driving transistors is two and the two first driving transistors are the first driving sub-transistor and the second driving sub-transistor, respectively.

3. The organic light-emitting display panel according to claim 1, wherein a width-to-length ratio of the first driving sub-transistor is $W_{1a}/L_{1a}$, a width-to-length ratio of the second driving sub-transistor is $W_{1b}/L_{1b}$, and a width-to-length ratio of each of the one or more second driving transistors is $W_2/L_2$, where $W_{1a}/L_{1a}+W_{1b}/L_{1b}=n*W_2/L_2$.

4. The organic light-emitting display panel according to claim 3, wherein a length $L_{1a}$ of the first driving sub-transistor is equal to a length $L_{1b}$ of the second driving sub-transistor and is equal to a length $L_2$ of each of the one or more second driving transistors, where $W_{1a}+W_{1b}=n*W_2$.

5. The organic light-emitting display panel according to claim 3, wherein a width $W_{1a}$ of the first driving sub-transistor is equal to a width $W_{1b}$ of the second driving sub-transistor and is equal to a width $W_2$ of each of the one or more second driving transistors, where $L_{1a}*L_{1b}/(L_{1a}+L_{1b})=L_2/n$.

6. The organic light-emitting display panel according to claim 3, wherein the operating current of the first sub-pixel at the preset grayscale is twice the operating current of the second sub-pixel at the preset grayscale; and $$W_{1a}/L_{1a}=W_2/L_2 \text{ and } =W_{1b}/L_{1b}=W_2/L_2.$$

7. The organic light-emitting display panel according to claim 3, wherein the operating current of the first sub-pixel at the preset grayscale is 1.5 times the operating current of the second sub-pixel at the preset grayscale; and $$W_{1a}/L_{1a}=0.5\ W_2/L_2 \text{ and } W_{1b}/L_{1b}=W_2/L_2, \text{ or } W_{1a}/L_{1a}=W_2/2*L_2 \text{ and } W_{1b}/L_{1b}=W_2/L_2.$$

8. The organic light-emitting display panel according to claim 3, wherein the operating current of the first sub-pixel at the preset grayscale is 1.5 times the operating current of the second sub-pixel at the preset grayscale; and $$W_{1a}/L_{1a}=0.75*W_2/L_2 \text{ and } W_{1b}/L_{1b}=0.75*W_2/L_2.$$

9. The organic light-emitting display panel according to claim 1, wherein each of the pixel driving circuits further comprises a first power supply voltage terminal and a storage capacitor; wherein each driving transistor of each pixel driving circuit comprises a first electrode connected to the first power supply voltage terminal, a gate electrode connected to a first terminal of the storage capacitor, and a second electrode connected to each sub-pixel corresponding to the pixel driving circuit; and wherein a second terminal of the storage capacitor is electrically connected to the first power supply voltage terminal.

10. The organic light-emitting display panel according to claim 9, wherein each pixel driving circuit further comprises an initialization signal terminal, a data signal terminal, a gate initialization transistor, an anode initialization transistor, a data writing transistor, a power supply voltage writing transistor, a compensation transistor and a light-emitting control transistor;

wherein the gate initialization transistor is connected in series between the initialization signal terminal and the gate electrode of the driving transistor so as to transmit an initialization signal to the gate electrode of the driving transistor under a control of a first scanning control signal;

wherein the anode initialization transistor is connected in series between the initialization signal terminal and an anode of the sub-pixel and is configured to transmit the initialization signal to the anode of the sub-pixel under a control of the first scanning control signal or a second scanning control signal;

wherein the data writing transistor is connected in series between the data signal terminal and a first electrode of the initialization transistor and is configured to transmit a data signal to the gate electrode of the driving transistor under a control of the second scanning control signal;

wherein the compensation transistor is connected in series between the second electrode and the gate electrode of the driving transistor and is configured to compensate a deviation of a threshold voltage of the driving transistor under a control of the second scanning control signal;

wherein the power supply voltage writing transistor is connected in series between the first power supply voltage terminal and the first electrode of the driving transistor and is configured to transmit a first power supply voltage to the gate electrode of the driving transistor under a control of a luminescence control signal; and wherein the light-emitting control transistor is connected in series between the second electrode of the driving transistor and the anode of the sub-pixel and is configured to transmit a driving current generated by the driving transistor to the sub-pixel.

11. The organic light-emitting display panel according to claim 10, wherein the first pixel driving circuit further comprises a first storage capacitor, the second pixel driving circuit further comprises a second storage capacitor, and a capacitance of the first storage capacitor is greater than a capacitance of the second storage capacitor.

12. The organic light-emitting display panel according to claim 10, wherein the first pixel driving circuit further comprises a first storage capacitor; the first storage capacitor comprises a first electrode plate located in a gate layer and a second electrode plate located in a capacitor metal layer; the first electrode plate acts as a gate electrode of the first driving transistor; the second electrode plate comprises a first via hole; a second electrode of the gate initialization transistor comprises a connection portion arranged in a source/drain metal layer and electrically connected to the first electrode plate through the first via hole; and a distance between the first via hole and the first driving sub-transistor is equal to a distance between the first via hole and the second driving sub-transistor.

13. An organic light-emitting display panel comprising sub-pixels and pixel driving circuits for driving the sub-pixels;

wherein the sub-pixels comprise a first sub-pixel and a second sub-pixel, and the pixel driving circuits comprise a first pixel driving circuit and a second pixel driving circuit;

wherein the first pixel driving circuit comprises first driving transistors and is configured to drive the first sub-pixel, and the second pixel driving circuit comprises one or more second driving transistors and is configured to drive the second sub-pixel;

wherein an operating current of the first sub-pixel at a preset grayscale is n times an operating current of the second sub-pixel at the preset grayscale, where $n \geq 1.5$;

wherein the first driving transistors comprise a first driving sub-transistor and a second driving sub-transistor, wherein a gate electrode of the first driving sub-transistor is electrically connected to a gate electrode of the second driving sub-transistor; a first electrode of the first driving sub-transistor is electrically connected to a first electrode of the second driving sub-transistor; a second electrode of the first driving sub-transistor is electrically connected to a second electrode of the second driving sub-transistor; and a number of transistors of the one or more second driving transistors is smaller than a number of transistors of the first driving transistors;

wherein each of the one or more second driving transistors comprises a first linear portion, a first bending portion, and a second linear portion that are connected to each other;

wherein the first driving sub-transistor comprises a third linear portion, a second bending portion, and a fourth linear portion that are connected to each other; and wherein the second driving sub-transistor comprises a fifth linear portion, a third bending portion, and a sixth linear portion that are connected to each other, wherein the second bending portion and the third bending portion are axisymmetric to each other about an extending line of the third linear portion; the fifth linear portion is used as the third linear portion; and the sixth linear portion is used as the fourth linear portion.

14. The organic light-emitting display panel according to claim 13, wherein the first driving sub-transistor and the second driving sub-transistor are axisymmetric to each other about the extending line of the third linear portion.

15. The organic light-emitting display panel according to claim 13, wherein a maximum distance between the second bending portion and the third bending portion is smaller than a preset threshold.

16. The organic light-emitting display panel according to claim 15, wherein the pixel driving circuits are made of a low temperature poly-silicon semiconductor and the preset threshold is equal to a step value of a laser crystallization for the low temperature poly-silicon semiconductor.

17. An organic light-emitting display device, comprising an organic light-emitting display panel which comprises sub-pixels and pixel driving circuits for driving the sub-pixels;

wherein the sub-pixels comprise a first sub-pixel, a second sub-pixel, and a third sub-pixel, and the pixel driving circuits comprise a first pixel driving circuit, a second pixel driving circuit, and a third pixel driving circuit;

wherein the first pixel driving circuit comprises first driving transistors and is configured to drive the first sub-pixel, the second pixel driving circuit comprises one or more second driving transistors and is configured to drive the second sub-pixel, and the third pixel driving circuit comprises one or more third driving transistors and is configured to drive the third sub-pixel;

wherein an operating current of the first sub-pixel at a preset grayscale is n times an operating current of the second sub-pixel at the preset grayscale, where $n \geq 1.5$;

wherein the first driving transistors comprise a first driving sub-transistor and a second driving sub-transistor, wherein a gate electrode of the first driving sub-transistor is electrically connected to a gate electrode of the second driving sub-transistor; a first electrode of the first driving sub-transistor is electrically connected to a first electrode of the second driving sub-transistor; a second electrode of the first driving sub-transistor is electrically connected to a second electrode of the second driving sub-transistor; and a number of transistors of the one or more second driving transistors is smaller than a number of transistors of the first driving transistors; and wherein an operating current of the third sub-pixel at the preset grayscale is m times the operating current of the second sub-pixel at the preset grayscale, where $0.9 \leq m \leq 1.1$; and a number of transistors of the one or more third driving transistors is equal to the number of transistors of the one or more second driving transistors.

18. The organic light-emitting display device according to claim 17, wherein the first sub-pixel is a blue sub-pixel, and the second sub-pixel and the third sub-pixel are a red sub-pixel and a green sub-pixel, respectively;

wherein both the number of transistors of the one or more second driving transistors and the number of transistors of the one or more third driving transistors is one; and wherein the number of transistors of the first driving transistors is two and the two first driving transistors are the first driving sub-transistor and the second driving sub-transistor, respectively.

* * * * *